US006132124A

United States Patent [19]

Ogura et al.

[11] Patent Number: 6,132,124

[45] **Date of Patent: *Oct. 17, 2000**

[54] INK FOLLOWER FOR AQUEOUS BALLPOINT PEN USING GEL-LIKE MATERIAL AND SOLID PIECE

[75] Inventors: Norio Ogura; Kazuhiko Furukawa, both of Yokohama; Katsuhiko Shiraishi, Fujioka, all of Japan

[73] Assignee: Mitsubishi Pencil Kabushiki Kaisha, Tokyo, Japan

[ * ] Notice: Under 35 U.S.C. 154(b), the term of this patent shall be extended for 687 days.

[21] Appl. No.: 08/654,766

[22] Filed: May 29, 1996

Related U.S. Application Data

[63] Continuation of application No. 08/292,773, Aug. 18, 1994, abandoned.

[30] Foreign Application Priority Data

Aug. 31, 1993 [JP] Japan ..... 5-216591

[51] Int. Cl.[7] ..... B43K 7/08

[52] U.S. Cl. ..... 401/141; 401/142

[58] Field of Search ..... 401/141, 142

[56] References Cited

U.S. PATENT DOCUMENTS

| | | | |
|---|---|---|---|
| 3,334,616 | 8/1967 | Urquhart | 401/142 |
| 4,671,691 | 6/1987 | Case et al. . | |
| 5,348,989 | 9/1994 | Shiraishi . | |

FOREIGN PATENT DOCUMENTS

| | | | |
|---|---|---|---|
| 158350 | 5/1952 | Australia | 401/142 |
| 646258 | 8/1962 | Canada | 401/142 |
| 1126011 | 11/1956 | France | 401/142 |
| 1.302.658 | 7/1962 | France . | |
| 1.497.176 | 10/1967 | France . | |
| 595093 | 7/1957 | Italy | 401/142 |
| 4930035 | 6/1974 | Japan | 401/142 |
| 57-153070 | 9/1982 | Japan . | |
| 57-200472 | 12/1982 | Japan . | |
| 1057673 | 3/1986 | Japan | 401/142 |
| 61-57673 | 3/1986 | Japan . | |
| 61-145269 | 7/1986 | Japan . | |
| 61-151289 | 7/1986 | Japan . | |
| 61-200187 | 9/1986 | Japan . | |
| 61-268786 | 11/1986 | Japan . | |
| 2050379 | 3/1987 | Japan | 401/142 |
| 62-50379 | 3/1987 | Japan . | |
| 62-148581 | 7/1987 | Japan . | |
| 63-6077 | 1/1988 | Japan . | |
| 798897 | 7/1958 | United Kingdom | 401/142 |
| WO 86/04345 | 7/1986 | WIPO . | |

*Primary Examiner*—David J. Walczak
*Attorney, Agent, or Firm*—Darby & Darby

[57] ABSTRACT

The present invention provides an ink follower for an aqueous ballpoint pen having an ink reservoir for directly preserving an ink, and this ink follower comprises at least a gel-like material having a predominantly viscous response and comprising a less volatile solvent having a viscosity of 5 Pa·sec or less and a hydrophobic thickening agent, and a solid piece having a specific gravity of 0.80 to 1.10. In addition, the present invention provides a ballpoint pen using this ink follower.

The ink follower of the present invention is characterized by using the gel-like material having a high flowability and the solid piece for dispersing and absorbing impact. This ink follower has a strong drop impact resistance, in contrast to a conventional gel-like ink control plug. The aqueous ballpoint pen using this ink follower does not lose its function, even when it is dropped from a shelf at a height of 1.5 m.

16 Claims, 2 Drawing Sheets

FIG. IC
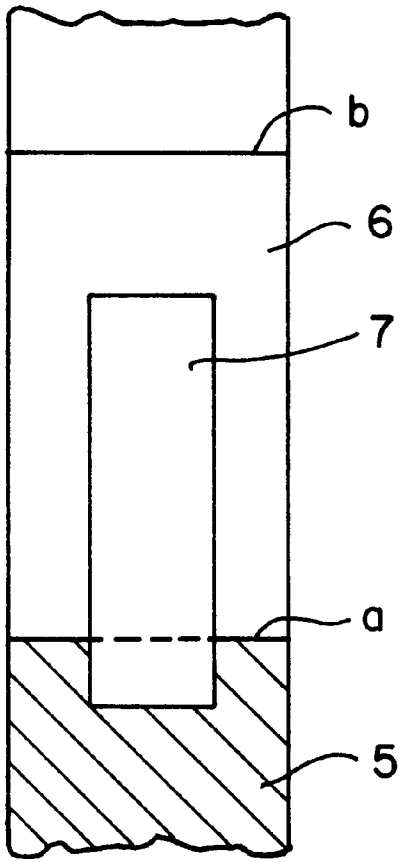
FIG. IB
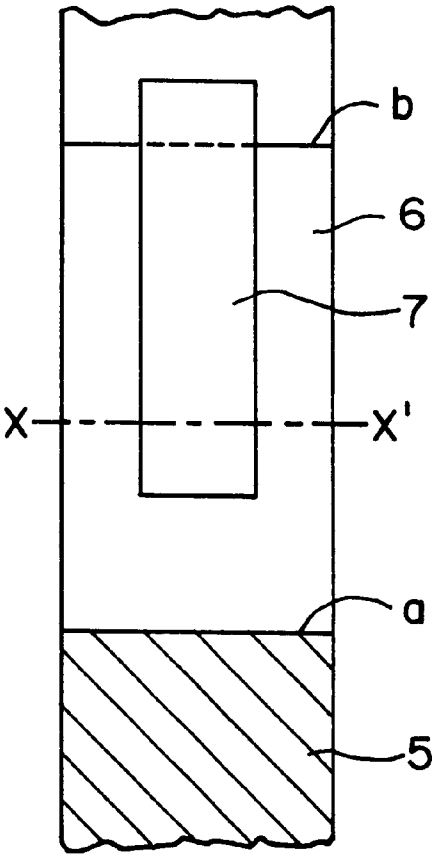
FIG. IA
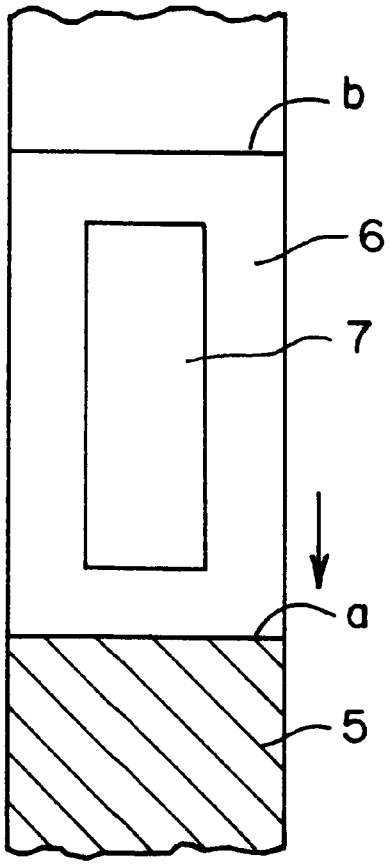

INK FOLLOWER FOR AQUEOUS BALLPOINT PEN USING GEL-LIKE MATERIAL AND SOLID PIECE

This is a continuation of application Ser. No. 08/292,773, filed Aug. 18, 1994 now abandoned.

BACKGROUND OF THE INVENTION (i) Field of the Invention

The present invention relates to an ink follower which is used at the rear end of an ink for an aqueous ballpoint pen directly received in an ink reservoir, and it also relates to a ballpoint pen equipped with the ink follower.

(ii) Description of the Related Art

The viscosity of the ink of an aqueous ballpoint pen is in the range of 0.01 Pa·sec to 3 Pa·sec, which is much lower than the viscosity of an oily ballpoint pen having a similar structure, i.e., 3 Pa·sec to 20 Pa·sec. Thus, if the pen is allowed to stand upwardly or sideways, the ink leaks out. In addition, the ink of the aqueous ballpoint pen leaks even by a light impact which may soil hands or clothing sometimes, and therefore, in order to prevent leakage, an ink follower is provided. This ink follower is also called "an ink control plug".

In Japanese Patent Application Laid-open Nos. (Sho) 57-153070, 57-200472, 61-57673, 61-145269, 61-151289, 61-200187, 61-268786, 62-50379 and 62-148581, it has been disclosed that gel-like ink control plugs are attached to aqueous ballpoint pens in which an ink is directly received in an ink reservoir.

These ink control plugs can sufficiently prevent the ink from leaking out when the aqueous ballpoint pens are positioned in a vertical or horizontal orientation, and they withstand a light drop impact. Of the light drop impacts, the strongest example is a case where the pen drops on a floor from a desk (about 70 cm). In this case, even a conventional ink follower scarcely gives rise to any trouble, through the ink follower slightly shifts.

However, when the conventional ink follower suffers a strong drop impact, the ink follower will shift, resulting in potential structural failure. For example, a drop of a pen from a shelf at a height of about 150 cm is not so rare, and in this case, the impact is twice or more as much as the drop from the desk (about 70 cm) that is applied to the ballpoint pen. In consequence, the viscosity of the ink follower noticeably lowers, so that this ink follower scatters in the ink reservoir. As a result, the ink may leak. In addition, when the contents in the ink reservoir leak in this way, an excessive pressure is applied to a penpoint or its adjacent parts, so that the ball in the ballpoint springs out from the tip holder at times.

A conventional ink follower is formed by imparting a pseudoplasticity to a non-aqueous base oil by the use of silica fine particles. As this pseudoplasticity is strong, the viscosity behavior of the ink drastically alters by the strong impact, and so the viscosity of the ink is affected by the strong drop impact.

As described above, the light drop impact is not so influential, but a tendency that the mechanism of the ink follower will malfunction due to the strong drop impact is remarkable, as the viscosity of the base oil in the ink follower is low. However, the lower the viscosity of the base oil is, the better the follow-up performance of the follower to the ink is, and conversely, the higher the viscosity of the base oil is, the worse the follow-up performance of the follower to the ink is.

For example, U.S. Pat. No. 4,671,691 discloses a viscoelastic ink follower comprising 49% of polybutene, 49% of a mineral oil and 2% of dimethyldioctadecylammonium-bentonite. Briefly describing this ink follower from the viewpoint of the present invention, a clay-based thickening agent is used to impart the weak pseudoplasticity to the high-viscosity base oil, but the follow-up performance of the follower to the ink is poor, though the impact resistance is excellent.

SUMMARY OF THE INVENTION

An object of the present invention is to eliminate the drawback of an ink follower used in a conventional aqueous ballpoint pen, i.e., to solve a problem that when impact resistance is improved, the ink follower does not malfunction. That is to say, the object of the present invention is to provide an ink follower having an improved impact resistance to a strong drop impact and a reliable follow-up performance by the ink follower (an ink follow-up performance).

Needless to say, the ink follower to be provided by the present invention should have an effect that the ink is shut out from the open air to prevent the same from volatilizing (a volatilization preventing function), and an effect that the ink is prevented from leaking out from the rear end of an ink reservoir when upward writing is made (a leakage preventing function).

Another object of the present invention is to provide an aqueous ballpoint pen in which a writing performance is scarcely affected even when a strong drop impact is applied to the aqueous ballpoint pen.

It is a further object of the present invention when a solid piece is introduced into a gel-like material, the applied drop impact is dispersed in the gel-like material, and that even the gel-like material using a low-viscosity base oil with a good ink follow-up performance also withstands the strong drop impact.

That is to say, an ink follower for an aqueous ballpoint pen of the present invention comprises a gel-like material having shear-thinning properties and showing a slightly predominantly viscous response in the range of a shear rate of 1 to 30000 $sec^{-1}$ or a corresponding shear frequency, and a solid piece having a specific gravity of 0.80 to 1.10 introduced into the gel-like material.

The present invention is directed to an aqueous ballpoint pen having an ink reservoir for directly preserving an ink, an ink follower of the aqueous ballpoint pen comprising a gel-like material having a tan 6 of more than 1.0 and a solid piece having a specific gravity of 0.80 to 1.10.

This gel-like material preferably has a loss tangent $\delta$ of more than 1.0 in the range of a shear rate of 5 to 3000 $sec^{-1}$ or a corresponding shear frequency when a strain ratio of 10 to 200% is given.

As the above-mentioned gel-like material, there can be used a gel-like material which comprises at least one base oil selected from the group consisting of mineral oils, silicone oils and a polybutene having a molecular weight of 500 to 3000 and having a viscosity of 5 Pa·sec or less at 25° C., and a hydrophobic silica whose surface has been subjected to a methylation treatment.

The preferable solid piece mentioned above is a columnar or a tubular molded article having an outer diameter less than the inner diameter of the ink reservoir and a length more than the inner diameter of the ink reservoir.

BRIEF DESCRIPTION OF THE DRAWINGS

The position of a solid piece in a gel-like material of an ink follower is shown in FIGS. 1A, 1B, and 1C, FIG. 1A showing that the solid piece lies at the center of the gel-like material, FIG. 1B showing the solid piece slightly outward protruding from the rear end of the gel-like material, and FIG. 1C showing the solid piece into the ink.

DETAILED DESCRIPTION OF PREFERRED EMBODIMENTS

Figure 2:
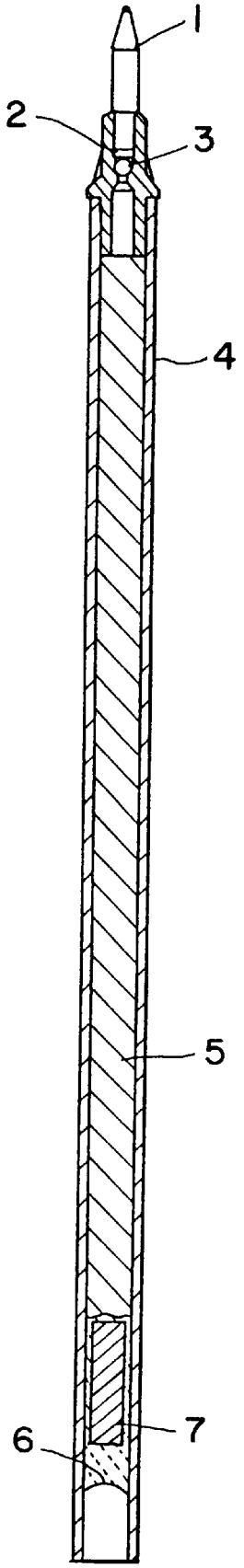
FIG. 2 is a sectional view showing one example of an ink reservoir and its tip of an aqueous ballpoint pen using the ink follower of the present invention.

A gel-like material which can be used in an ink follower of the present invention contains a base oil and a thickening agent, and if necessary, a surface active agent is further contained in the gel-like material. In the preferable gel-like material, the viscosity of the base oil is low, and the preferable gel-like material shows a predominantly viscous response (tan $\delta>1$, i.e., a viscoelastic substance in which flowability is predominant). Furthermore, the gel-like material having a good ink follow-up performance is preferable.

Here, the tan $\delta$ is a value which means a loss elastic modulus/a storage elastic modulus. This high value means that the flowability is high (or a viscous substance), and this low value means that the gel-like material is close to a solid state (or an elastic substance).

The base oil which can be used in this gel-like material is non-volatile or less volatile, and more specifically, it is a low-viscosity solvent in which a volatilization loss at 98° C. for 5 hours is 0.4% or less, and it is selected from water-insoluble organic solvents. The preferable base oil is selected from the group consisting of mineral oils, silicone oils and a polybutene having a molecular weight of 500 to 3000. The viscosity of the base oil is 5 Pa·sec or less, preferably 2 Pa·sec or less at 25° C.

In general, in order to prevent the ink from back-leaking when the ballpoint pen lies in an upward or a sideways state, and in order to obtain resistance to a weak drop impact, the predominantly elastic response (i.e., the tan $\delta<1$) is given to the gel-like material which can be used in the aqueous ballpoint pen, at a low shear rate or in a low frequency range measured at a low strain ratio. The viscosity of the base oil in this case is 2 Pa·sec or less at 25° C., preferably 1 Pa·sec or less. If the viscosity of the base oil is in excess of 2 Pa·sec, the follow-up performance to the ink is poor, and when a line is written at a high-speed of about 10 cm/sec which is considered to be a writing speed at which a straight line is generally drawn along a ruler, the thus written line is noticeably thinner than written letters. In addition, this high viscosity of the base oil also causes line skips and starving at times.

However, the gel-like material which can be used in the present invention is designed so that the viscous response (the loss elastic modulus) may exceed the elastic response (the storage elastic modulus) (i.e., the tan $\delta>1$). In addition, the gel-like material is more excellent in the flowability than in the case of a usual gel-like ink follower, and so the gel-like material has the good follow-up performance to the ink and the quality of the line drawn at the high-speed is not impaired, so long as the viscosity of the base oil is not in excess of 5 Pa·sec.

Furthermore, the thickening agent which can be used in the gel-like material is selected from hydrophobic and non-aqueous thickening agents. If a hydrophilic thickening agent is used, the thickening agent transfers into the ink through the interface between the gel-like material and the ink, so that the pseudoplasticity of the ink follower is substantially diminished. In consequence, when the ballpoint pen is allowed to stand upward, the ink flows backward, and the base oil floats in the ink, so that the ballpoint pen is non-functional.

Examples of the preferable thickening agent which can be used in the present invention include silica fine particles whose surface has been subjected to a methylation treatment such as "Aerosyl R-972", "R-974D" and "R-976D" made by Nippon Aerosyl Co., Ltd., thickening agents obtained by subjecting dimethyldioctadecylammoniumbentonite to an onium treatment to make the surface of the same hydrophobic, and non-aqueous metallic soaps such as lithium stearate, aluminum stearate and sodium stearate. These thickening agents may be used singly or in combination.

The amount of the thickening agent to be used is preferably in the range of 1 to 6% by weight based on the total weight of the gel-like material. If the amount of the thickening agent is less than 1%, the sufficient pseudoplasticity of the ink follower cannot be sufficiently obtained, and if it is more than 6%, the elastic response often exceeds the viscous response.

However, even if the amount of the thickening agent is less than 1% or more than 6%, the performance of the ink follower is not affected, so long as the gel-like material has viscoelastic properties.

As the thickening agent, a resin or a rubber can be used, if necessary. However, when such a material is used, the elastic response increases, and for this reason, it is not preferable to use such a material in large quantities.

In the gel-like material which can be used in the ink follower of the present invention, a surface active agent can be used, if necessary. The employment of the surface active agent is an effective means for improving the follow-up performance to the ink. No particular restriction is put on the kind of surface active agent at all, but such a surface active agent as dissolves into the ink with time during storage is not preferable, and a nonionic surface active agent having an HLB (a hydrophilic-lipophilic balance) of 4 or less is preferable. In addition, the surface active agents called fluorine-based surface active agents and silicone-based surface active agents are most preferable, because they can noticeably decrease the surface tension of the base oil.

The amount of the surface active agent to be added is preferably in the range of 0.01 to 5% by weight based on the weight of the thickening agent. Even if the amount of the surface active agent is in excess of 5% by weight, any performance of the gel-like material is not affected, but the further effect of the added surface active agent cannot be expected any more.

The solid piece which can be used in the ink follower of the present invention is longer in a longitudinal direction (l) shown in FIG. 1A than the inner diameter of the ink follower and is shorter than the whole length of the ink reservoir. The solid piece illustrated in FIG. 1B has a sectional area of from 10% to 95% of the sectional area of the ink reservoir when measured along the line X–X' of FIG. 1B. The solid piece having an intentionally increased surface area and contact area with the gel-like material is effective, even if the sectional area of the solid piece is about 10% of that of the ink reservoir, but with regard to the solid piece having a simple shape such as a cylinder, a prism or a tube, its sectional area preferably is 30% or more of that of the ink reservoir.

If the length of the solid piece in the longitudinal direction of the ballpoint pen is less than the inner diameter of the ink reservoir, the solid piece tends to lie in a sideways state in the gel-like material, and in this case, the ability of the solid piece to disperse the impact cannot be exerted, and the slide properties of the solid piece in the ink reservoir are poor. In a worst case, the solid piece cannot follow the gel-like material any more. If the solid is longer than the whole length of the ink follower, it can be presumed that the solid piece alone is completely drawn from the ink follower, when the ink has been consumed to some extent.

If the sectional area of the solid piece is too small, for example, less than 10% of that of the ink reservoir, the ability of the solid piece to absorb the impact cannot be exerted. If the sectional area of the solid piece is in excess of 95%, the slide properties of the solid piece are poor owing to the uneven inner diameter of the ink reservoir at times.

Furthermore, the specific gravity of this solid piece must be in the range of 0.80 to 1.10. In general, this requirement is based on facts that the specific gravity of a solvent such as a polybutene, a mineral oil or a silicone oil used as the base oil is about 0.80 or more, that the specific gravity of the gel-like material depends upon that of this base oil, and that the specific gravity of the ink is usually 1.10 or less.

If the specific gravity of the solid piece is noticeably smaller than that of the gel-like material, the solid piece floats in the gel-like material, so that the reinforcement effect of the gel-like material to the drop impact cannot be exerted. In addition, if the specific gravity of the solid piece is larger than that of the ink, the solid piece sinks in the ink, so that the solid piece cannot function any more as the nucleus of the gel-like material.

In addition, the solid piece may slightly swell with the base oil of the gel-like material, but the solid piece which noticeably swell with or dissolves in the base oil is not preferable. This requirement of the solid piece is also applied to the ink.

Thus, examples of a material for the solid piece which can be used in the ink follower of the present invention include synthetic resins such as polyethylene, polypropylene and polystyrene, rubbers such as natural rubbers, nitrile rubbers, polyisobutylenes and the like, lumbers, synthetic and natural resins and metals having closed cells and an apparent specific gravity of 0.80 to 1.10. From the viewpoint of industrial production, the synthetic resins and the synthetic rubbers having a good workability and a controlled quality unevenness are preferable.

Even if having any shape, the solid piece for use in the ink follower of the present invention can exert the effect, so long as the solid piece can slide at a suitable interval from the ink reservoir without any trouble. For the sake of the industrial production, the cylindrical solid piece and the tubular solid piece having both the open ends are preferable, because of easy handling.

The gel-like material which can be used in the ink follower of the present invention can be manufactured by the same procedure as in the conventional technique of the ink follower. One example using a hydrophobic silica and a clay-based thickening agent is an extremely simple process which comprises preliminarily kneading all the gel-like material components of the base oil, the surface active agent and the like at room temperature, and then kneading them by a dispersion mixer such as a triple roll mill or a kneader. In the case that a metallic soap is used as the thickening agent, this thickening agent must be heated to a high temperature of 200° C. or more prior to the kneading step, and the surface active agent must be added after cooling in compliance with its heat resistance.

One example for introducing, into the gel-like material, the solid piece for use in the ink follower of the present invention comprises filling the ink reservoir with the ink, attaching a penpoint to the ink reservoir, filling the rear end of the ink with the gel-like material, and then inserting the solid piece into the ink reservoir from its rear end. Afterward, a strong centrifugal force is applied in the direction of from the rear end of the ink reservoir to the penpoint by a centrifugal separator, whereby the solid piece is introduced into the gel-like material. The introduction of the solid piece into the center of the gel-like material shown in FIG. 1A is ideal, but even if not so, for example, even in the case of FIG. 1B or FIG. 1C, the function of the solid piece is not affected at all.

With regard to the ballpoint pen using the follower of the present invention, as shown in FIG. 2, the ink is received in the ink reservoir capable of directly receiving the ink, and the penpoint comprising a ball and a tip holder is mounted on the tip of the ink reservoir. Afterward, the ink follower comprising the gel-like material and the solid piece is inserted thereinto. The ink reservoir has an inner diameter of 3 mm or more and a cylindrical shape or a similar shape, and for example, a tube made of a polypropylene or the like can be used.

In general, in the case of the ink follower comprising the gel-like material alone, if the elastic response of the gel-like material exceeds the viscous response (i.e., in the case of the tan $\delta<1$), impact such as the drop impact is first absorbed by the gel-like material and then dispersed. That is to say, the excellent drop impact resistance can be exerted. However, the gel-like material simultaneously absorbs all of the external forces, and therefore a negative pressure by the flow of the ink is also absorbed, so that the smooth flow of the ink through the penpoint is disturbed at the time of writing.

The solid piece of the ink follower according to the present invention has the function of absorbing and dispersing impact such as the drop impact by the solid material which is the nucleus, and so the ability to absorb the impact does not have to be required in the gel-like material. Therefore, even if the gel-like material in which the viscous response exceeds the elastic response (i.e., the flowability is good) is used in the span of from a low shear rate region to a high shear rate region, the ink-follower of the present invention can sufficiently withstand the drop impact and so it does not disturb the smooth flow of the ink.

The ink follower for the aqueous ballpoint pen of the present invention has extremely good ink follow-up properties, can prevent the leakage of the ink and the detachment of the ball even when the ballpoint pen experiences a strong drop impact, and is excellent in a leakage prevention effect.

EXAMPLES

The present invention will be described in more detail with reference to examples and comparative examples.

Measurements and tests in the examples and the comparative examples were carried out as follows:

Viscosity:

The viscosities of a base oil and an ink were measured by the use of an EMD viscometer made by Toki Sangyo Co., Ltd.

Loss tangent (tan $\delta$):

The loss tangent was measured by the use of an "MR-500 type Leometer" made by Leology Co., Ltd. A measuring jig was a parallel plate having a diameter of 40 mm, a gap width was 0.32 mm, and a strain angle was about 10 so that a given strain ratio might be about 100%.

In each of the examples and the comparative examples, 30 ballpoint pens were prepared by the following procedures, and the following tests were then carried out.

Ink follow-up performance:

The follow-up performance to an ink was inspected by writing helical lines at a velocity of 4.5 m/min with 10 aqueous ballpoint pens until the ink had been empty. The evaluation criterion of the ink follow-up performance was as follows:

o: A case where a gel-like material scarcely adhere to the wall of an ink reservoir.

n: A case where the adhesion of the gel-like material to the wall was observed.

m: A case where a large amount of the gel-like material adhered to the wall and the gel-like material present at the rear end of the ink was completely consumed in the middle of writing.

Drop impact test:

Caps were removed from 10 aqueous ballpoint pens, and these ballpoint pens were dropped on a concrete from a height of 1.5 m so that the rear end of each pen hit against the concrete. Then, there were counted the number of the ballpoint pens from which the ink leaked, and the number of the ballpoint pens from which a ball sprang out.

Ink leakage by back flow:

Writing was made with the 10 aqueous ballpoint pens in a penpoint-upward state until lines had not been written any more, and they were stood on a test tube stand so that the penpoints might be upward, thereby allowing the ink to back flow. The number of the aqueous ballpoint pens in which the ink leaked from the ink reservoir was counted.

Aqueous ballpoint pen:

The ink reservoir and the tip of the aqueous ballpoint pen are as shown in FIG. 2, and an ink reservoir 4 comprising a semitransparent polypropylene tube having an inner diameter of 4.0 mm was filled with a predetermined ink 5 and each of ink followers 6 for the examples and the comparative examples. In the ink followers of Examples 1 to 3 and Comparative Example 4, about 0.12 g of a gel-like material was filled, and a solid piece 7, and in the ink followers of Comparative Examples 1 to 3, 0.15 g of the gel-like material was filled. The penpoint of each aqueous ballpoint pen was provided with the same ballpoint pen tip 1 as in the aqueous ballpoint pen having a usual ink occlusion material of a fiber bundle. The material of a ballpoint pen tip holder 2 was a free cutting stainless steel, and a ball 3 having a diameter of 0.5 mm was made of tungsten carbide.

The ink reservoir 4 was filled with the ink and the gel-like material, and after the attachment of the penpoint, the solid piece was introduced into the gel-like material from the rear end of the ink reservoir. Afterward, a centrifugal force was applied to the ink reservoir 4 at 2800 rpm for 10 minutes in the direction of from the rear end of the pen to the penpoint by an H-103N type centrifugal separator made in Kokusan Enshinnki Co., Ltd., whereby the solid piece was introduced into the gel-like material.

Ink for aqueous ballpoint pen:

An ink for the aqueous ballpoint pens which were used in the above-mentioned aqueous ballpoint pens was prepared as follows:

| | |
|---|---|
| Carbon black "Plintex 25" (made by Degussa) | 7 parts by weight |
| Polyvinyl pyrrolidone "PVP K-30" (made by GAF Co., Ltd.) | 3.5 parts by weight |
| Glycerin | 10 parts by weight |
| Calcium ricinoleate | 0.5 parts by weight |
| Triethanolamine | 1 part by weight |
| 1,2-benzisothiazoline-3-one | 0.2 part by weight |
| Benzotriazole | 0.2 part by weight |
| Water | 27.2 parts by weight |

The above-mentioned materials were kneaded by a bead mill, and coarse particles of carbon black were then removed therefrom. Afterward, the following materials were added thereto to obtain the ink for the aqueous ballpoint pen having a viscosity of 0.5 Pa·sec at 40 $sec^{-1}$.

| | |
|---|---|
| Propylene glycol | 20 parts by weight |
| Crosslinked polyacrylic acid "Carbopole" (made by B. F. Goodrich Co.) | 0.4 part by weight |
| Water | 30 parts by weight. |

Example 1

Gel-like material:

| | |
|---|---|
| Polybutene "Polybutene 35R" [made by Idemitsu Kosan Co., Ltd. MW = 720] | 47.4 parts by weight |
| Mineral oil "Dianaprocess Oil MC-S32" [made by Idemitsu Kosan Co., Ltd.] | 47.5 parts by weight |
| Hydrophobic silica "Aerosyl R-976D" [made by Nippon Aerosyl Co., Ltd.; BET surface area = 300 $m^2/g$] | 5 parts by weight |
| Fluorine-based surface active agent "Eftop EF-801" [made by Mitsubishi Material Co., Ltd.] | 0.1 part by weight |

The above-mentioned blend materials were kneaded by a triple roll mill to prepare a gel-like material for an ink follower.

Solid piece:

A cylindrically molded polypropylene article having a diameter of 3 mm and a length of 10 mm was used.

Example 2

Gel-like material:

| | |
|---|---|
| Polybutene "Nissan Polybutene 015N" [made by Nippon Oils & Fats Co., Ltd.; MW = 580] | 94 parts by weight |
| Hydrophobic silica "Aerosyl R-974D" [made by Nippon Aerosyl Co., Ltd.; BET surface area = 200 $m^2/g$] | 5 parts by weight |
| Silicone-based surface active agent "SILWET FZ-2110" [Nippon Yunika Co., Ltd.] | 1 part by weight |

The above-mentioned blend materials were kneaded by a triple roll mill to prepare a gel-like material for an ink follower.

Solid piece:

A nitrile rubber tube having an outer diameter of 3 mm, an inner diameter of 2 mm and a length of 5 mm was used.

Example 3

Gel-like material:

| | |
|---|---|
| Mineral oil "Dianaprocess Oil MC-W90" [made by Idemitsu Kosan Co., Ltd.] | 93 parts by weight |
| Hydrophobic silica "Aerosyl R-974D" (the same as in Example 2) | 6 parts by weight |
| Silicone-based surface active agent "SILWET FZ-2171" [Nippon Yunika Co., Ltd.] | 1 part by weight |

The above-mentioned blend materials were treated by the same procedure as in Example 1 to prepare a gel-like material for an ink follower.

Solid piece:

A polyethylene tube having an outer diameter of 3 mm, an inner diameter of 1.8 mm and a length of 15 mm was used.

Comparative Example 1

Gel-like material:

The same gel-like material as in Example 1 was used.

Solid piece: None

Comparative Example 2

Gel-like material:

The same gel-like material as in Example 2 was used.

Solid piece: None

Comparative Example 3

Gel-like material:

The same gel-like material as in Example 3 was used.

Solid piece: None

Comparative Example 4

| | |
|---|---|
| Polybutene "Polybutene 200N" [made by Nippon Oils & Fats Co., Ltd.; MW = 2650] | 43.3 parts by weight |
| Polybutene "Polybutene 30N" [made by Nippon Oils & Fats Co., Ltd.; MW = 1350] | 5.7 parts by weight |
| Mineral oil "Keidol" [made by Witoko Chemical Co., Ltd.] | 49 parts by weight |
| Dimethyldioctadecylammonium-bentonite "Benton 34" [made by Wilbereris Co., Ltd.] | 2 parts by weight |

The above-mentioned blend materials were treated by the same procedure as in Example 1 to prepare a gel-like material of Comparative Example 4.

Solid piece:

A polyethylene tube having an outer diameter of 3 mm, an inner diameter of 1.8 mm and a length of 15 mm was used.

TABLE 1

| | Ink Follower | | | | Test of Aqueous Ballpoint Pen | | |
|---|---|---|---|---|---|---|---|
| | Viscosity | Solid Piece | | | | | |
| | of Base Oil | Outer Diam. | Inner Diam. | Length | Ink Follow-up Performance | | |
| | (Pa•sec) | mm | mm | mm | o | n | m |
| Example 1 | 0.6 | 3.0 | 0 | 10 | 10 | 0 | 0 |
| Example 2 | 1.9 | 3.0 | 2 | 5 | 7 | 3 | 0 |
| Example 3 | 0.2 | 3.0 | 1.8 | 15 | 10 | 0 | 0 |
| Comp. Ex. 1 | 0.6 | None | None | None | 10 | 0 | 0 |
| Comp. Ex. 2 | 1.9 | None | None | None | 7 | 3 | 0 |
| Comp. Ex. 3 | 0.2 | None | None | None | 10 | 0 | 0 |
| Comp. Ex. 4 | 10.9 | 3.0 | 1.8 | 15 | 0 | 0 | 10 |

| | Test of Aqueous Ballpoint Pen | | |
|---|---|---|---|
| | Drop Impact Test | | Ink Leakage |
| | Ink Leakage (pens/10 pens) | Detachment of Ball (pens/10 pens) | by Back Flow (pens/10 pens) |
| Example 1 | 0 | 0 | 0 |
| Example 2 | 0 | 0 | 0 |
| Example 3 | 0 | 0 | 0 |
| Comp. Ex. 1 | 8 | 2 | 0 |
| Comp. Ex. 2 | 5 | 0 | 0 |
| Comp. Ex. 3 | 10 | 5 | 0 |
| Comp. Ex. 4 | 0 | 0 | 2 |

TABLE 2

Relation between tan δ of the gel-like material and angular velocity

| Angular Velocity (rad/sec) | Shear Rate ($sec^{-1}$) | Tan δ | | | |
|---|---|---|---|---|---|
| | | Example 1 | Example 2 | Example 3 | Comp. Example 4 |
| 0.06 | 3.93 | 3.80 | 4.05 | 2.47 | |
| 0.09 | 5.89 | 3.75 | 3.78 | 2.71 | |
| 0.13 | 7.85 | 3.64 | 3.28 | 3.19 | |
| 0.25 | 15.70 | 3.21 | 1.96 | 3.73 | 0.80 |
| 0.44 | 27.48 | 2.80 | 1.48 | 4.44 | |
| 0.63 | 39.25 | 2.40 | 1.36 | 5.09 | 0.92 |
| 0.94 | 58.88 | 2.33 | 1.30 | 5.49 | |
| 1.26 | 78.5 | 2.19 | 1.30 | 4.89 | |
| 2.51 | 157.0 | 2.20 | 1.39 | 2.83 | 1.46 |
| 4.40 | 274.8 | 2.50 | 1.54 | 1.91 | |
| 6.28 | 392.5 | 2.34 | 1.68 | 1.59 | |
| 9.42 | 588.8 | 2.66 | 1.87 | 1.42 | |
| 12.56 | 785 | 2.78 | 2.01 | 1.36 | |
| 25.12 | 1570 | 2.77 | 2.30 | 1.47 | |
| 43.96 | 2748 | 2.95 | 2.03 | 1.83 | |

What is claimed is:

1. An ink follower for an aqueous ballpoint pen having an ink reservoir which comprises:

a gel-like material having a tan 6 of more than 1.0 at each of a plurality of measuring points in the range of at least one of a shear rate of 5 to 3000 $sec^{-1}$ and a corresponding shear frequency when a strain ratio is 10 to 200%; and a solid piece introduced into the gel-like material, wherein said solid piece has a specific gravity of 0.80 to 1.10 which is substantially equal to the specific gravity of said gel-like material, said solid piece being longer than the inner diameter of the ink reservoir and being shorter than the length of the ink follower, said solid piece having a sectional area of 10% to 95% of the sectional area of the ink reservoir, said solid piece having an essentially uniform cross-sectional area along its entire longitudinal length.

2. The ink follower of claim 1, wherein said gel-like material comprises at least one base oil selected from the group consisting of mineral oils, silicone oils and a polybutene having a molecular weight of 500 to 3000 and having a viscosity of up to 5 pa·sec 25° C.; and a hydrophobic silica whose surface has been subjected to a methylation treatment.

3. The ink follower of claim 2, wherein the amount of the hydrophobic silica is in the range of 1 to 6% by weight based on the total weight of the gel-like material.

4. The ink follower of claim 1, wherein the solid piece is at least one of a columnar and a tubular molded article having an outer diameter less than the inner diameter of the ink reservoir and a length more than the inner diameter of the ink reservoir.

5. The ink follower for an aqueous ballpoint pen having an ink reservoir which comprises:

a gel-like material having a tan 6 of more than 1.0 at each of a plurality of measuring points in the range of at least one of a shear rate of 5 to 3000 $sec^{-1}$ and a corresponding shear frequency when a strain ratio is 10 to 200%, and including a non-ionic surface active agent having a hydrophilic-lipophilic balance of up to 4 which comprises at least one surface-active agent selected from the group consisting of fluorine-based surface active agents and silicone-based surface active agents; and a solid piece introduced into the gel-like material, wherein said solid piece has a specific gravity of 0.80 to 1.10 which is substantially equal to the specific gravity of said gel-like material, said solid piece being longer than the inner diameter of the ink reservoir and being shorter than the length of the ink follower, said solid piece having a sectional area of 10% to 95% of the sectional area of the ink reservoir, said solid piece having an essentially uniform cross-sectional area along its entire longitudinal length.

6. The ink follower of claim 5, wherein said gel-like material comprises at least one base oil selected from the group consisting of mineral oils, silicone oils and a polybutene having a molecular weight of 500 to 3000 and having a viscosity of up to 5 Pa·sec 25° C.; and a hydrophobic silica whose surface has been subjected to a methylation treatment.

7. The ink follower of claim 6, wherein the amount of the hydrophobic silica is in the range of 1 to 6% by weight based on the total weight of the gel-like material.

8. The ink follower of claim 5, wherein the solid piece is at least one of a columnar and a tubular molded article having an outer diameter less than the inner diameter of the ink reservoir and a length more than the inner diameter of the ink reservoir.

9. An aqueous ballpoint pen having an ink reservoir, equipped with an ink follower, for directly preserving an ink, comprising:

a gel-like material having a tan δ of more than 1.0 at each of a plurality of measuring points in the range of at least one of a shear rate of 5 to 3000 $sec^{-1}$ and a corresponding shear frequency when a strain ratio is 10 to 200%; and a solid piece introduced into the gel-like material, wherein said solid piece has a specific gravity of 0.80 to 1.10 which is substantially equal to the specific gravity of said gel-like material, said solid piece being longer than the inner diameter of the ink reservoir and being shorter than the length of the ink follower, said solid piece having a sectional area of 10% to 95% of the sectional area of the ink reservoir, said solid piece having an essentially uniform cross-sectional area along its entire longitudinal length.

10. The aqueous ballpoint pen of claim 9, wherein said gel-like material comprises at least one base oil selected from the group consisting of mineral oils, silicone oils and a polybutene having a molecular weight of 500 to 3000 and having a viscosity of up to 5 Pa·sec 25° C.; and a hydrophobic silica whose surface has been subjected to a methylation treatment.

11. The aqueous ballpoint pen of claim 10, wherein the amount of the hydrophobic silica is in the range of 1 to 6% by weight based on the total weight of the gel-like material.

12. The aqueous ballpoint pen of claim 9, wherein the solid piece is at least one of a columnar and a tubular molded article having an outer diameter less than the inner diameter of the ink reservoir and a length more than the inner diameter of the ink reservoir.

13. An aqueous ballpoint pen having an ink reservoir, equipped with an ink follower, for directly preserving an ink, comprising:

a gel-like material having a tan δ of more than 1.0 at each of a plurality of measuring points in the range of at least one of a shear rate of 5 to 3000 $sec^{-1}$ and a corresponding shear frequency when a strain ratio is 10 to 200%, and including a non-ionic surface active agent having a hydrophilic-lipophilic balance of up to 4 which comprises at least one surface-active agent selected from the group consisting of fluorine-based surface active agents and silicone-based surface active agents; and a solid piece introduced into the gel-like material, wherein said solid piece has a specific gravity of 0.80 to 1.10 which is substantially equal to the specific gravity of said gel-like material, said solid piece being longer than the inner diameter of the ink reservoir and being shorter than the length of the ink follower, said solid piece having a sectional area of 10% to 95% of the sectional area of the ink reservoir said solid piece having an essentially uniform cross-sectional area along its entire longitudinal length.

14. The aqueous ballpoint pen of claim 13, wherein said gel-like material comprises at least one base oil selected from the group consisting of mineral oils, silicone oils and a polybutene having a molecular weight of 500 to 3000 and having a viscosity of up to 5 Pa·sec 25° C.; and a hydrophobic silica whose surface has been subjected to a methylation treatment.

15. The aqueous ballpoint pen of claim 14, wherein the amount of the hydrophobic silica is in the range of 1 to 5% by weight based on the total weight of the gel-like material.

16. The aqueous ballpoint pen of claim 13, wherein the solid piece is at least one of a columnar and a tubular molded article having an outer diameter less than the inner diameter of the ink reservoir and a length more than the inner diameter of the ink reservoir.

* * * * *